United States Patent [19]

Amancharla

[11] 4,161,216

[45] Jul. 17, 1979

[54] MECHANICAL LATCH WITH HYDRAULIC LOCKING MECHANISM

[75] Inventor: Amareswar Amancharla, League City, Tex.

[73] Assignee: Baker International Corporation, Orange, Calif.

[21] Appl. No.: 946,235

[22] Filed: Sep. 27, 1978

[51] Int. Cl.[2] ..... E21B 23/00

[52] U.S. Cl. ..... 166/193; 166/125; 285/18; 285/DIG. 23

[58] Field of Search ..... 166/125, 315, 193, 194, 166/181; 285/18, DIG. 23

[56] References Cited

U.S. PATENT DOCUMENTS

| | | | |
|---|---|---|---|
| 2,409,811 | 10/1946 | Taylor, Jr. et al. | 166/193 |
| 3,037,797 | 6/1962 | Brown | 285/18 |
| 3,051,244 | 8/1962 | Litchfield | 285/18 |

*Primary Examiner*—James A. Leppink

*Attorney, Agent, or Firm*—William C. Norvell, Jr.

[57] ABSTRACT

An apparatus is provided for selective mechanically activated latching and fluid activated locking and unlocking of a tubular string within an anchor assembly in a subterranean bore, wherein the anchor assembly has defined thereon co-engaging elements for selectively latching and locking of a tubular string with the anchor assembly. The apparatus comprises a housing which contains second co-engaging means which are complimentarily operational with the first co-engaging means. A longitudinally shiftable sleeve is initially secured to at least one of the housing and the second co-engaging means and is initially positioned with respect to the second co-engaging means whereby the second co-engaging means is selectively and repeatably latchable with respect to the first co-engaging means. A first seat is provided within said shiftable sleeve for sealing receipt of a first sealing element whereby the sleeve is converted to a fluid responsive piston for longitudinal shifting of the sleeve or the second co-engaging means relative to the other of the sleeve and the co-engaging means to a first position whereby the first relative shifting to the first position locks the second co-engaging means with the first co-engaging means. Second seat means for sealing receipt of a second sealing element is provided whereby the sleeve means is again converted to a piston to longitudinally shift either the sleeve means or the co-engaging means relative to the other of the sleeve means and the co-engaging means to a second position to unlock the first and second co-engaging means.

68 Claims, 9 Drawing Figures

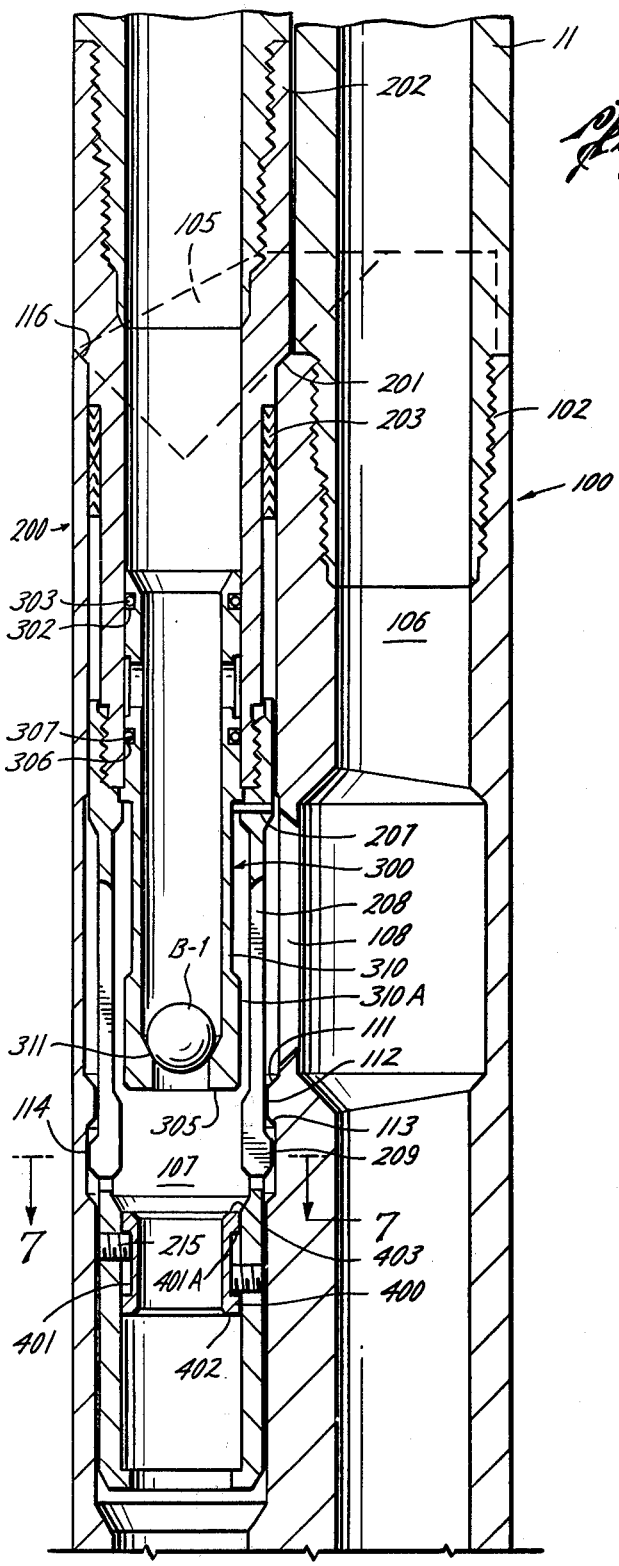
Fig. 3
Fig. 7
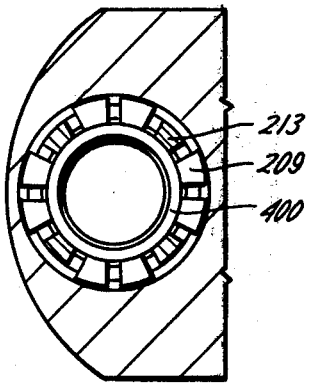

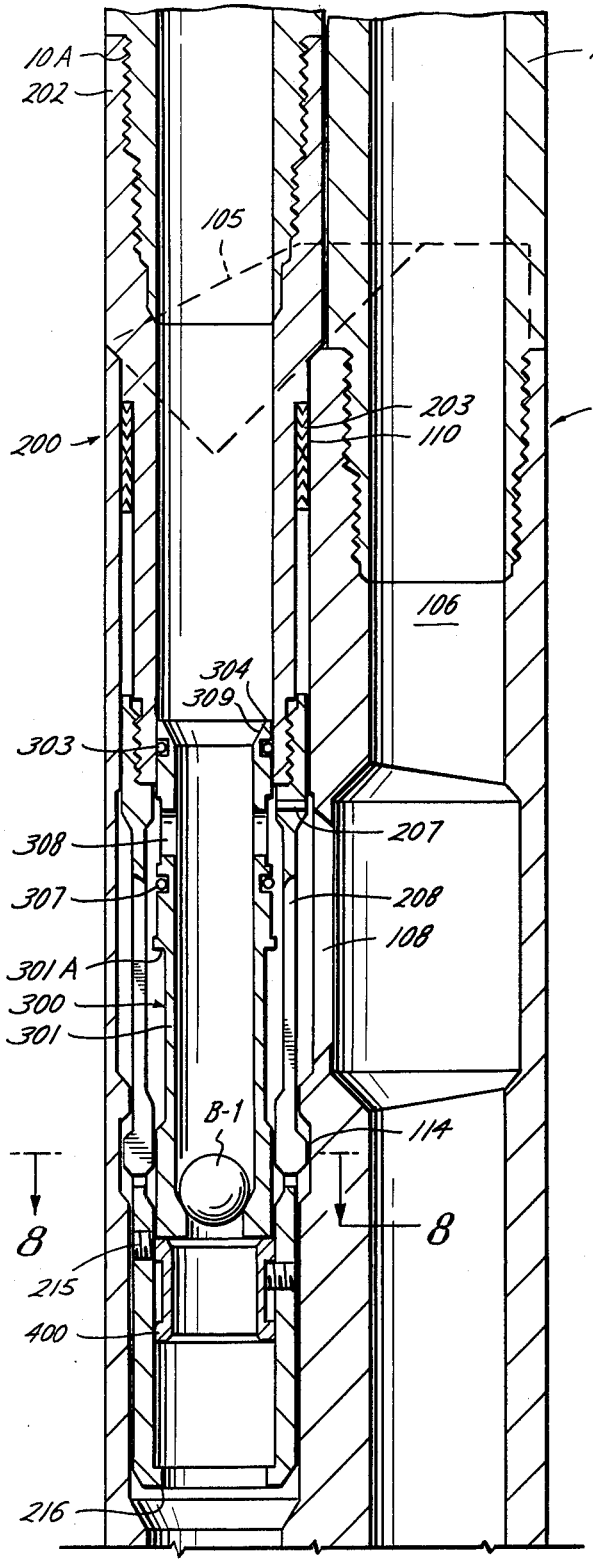
Fig. 4
Fig. 8
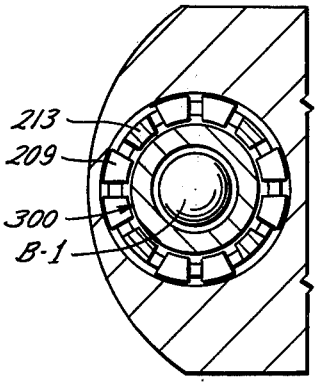

MECHANICAL LATCH WITH HYDRAULIC LOCKING MECHANISM

BACKGROUND OF THE INVENTION

1. FIELD OF THE INVENTION

The invention relates to a mechanical latch having an hydraulic locking mechanism which permits selective and repeatable latching of a tubular string into a connector, such as a crossover assembly, and which permits locking and unlocking of the tubular string therein hydraulically and without requirement of rotation or longitudinal movement of the tubular string.

2. DESCRIPTION OF THE PRIOR ART

Subterranean oil and gas wells oftentimes are drilled through a plurality of producing zones. In order to isolate these zones for selective production purposes, plural tubing strings are inserted into the well during the completion or workover operations. For example, in a well having two production zones, a first or "long" string is inserted into the well. Near the lower end of the "long" string, a single bore packer mechanism may be provided for isolating the lower zone from the well bore thereabove. A crossover assembly is carried on the "long" string above the packer mechanism for receipt of a second or "short" string which may be utilized to, for example, pump corrosion inhibitor, other treating fluids, or kill fluids from the top of the well to the upper zone. In the event that it is desired to circulate the treatment fluid within the tubing strings above the packer and the lower production zone, a crossover assembly is utilized which contains a manipulatable valve or other assembly to permit selective opening and closing of a port therein for communication across the crossover assembly between the "long" and the "short" strings. Of course, the "short" string may be open-ended to permit production from the upper zone therethrough.

Heretofore, the "short" string has been landed on the cross-over assembly, stung therein and locked by mechanical means, such as by use of a J-slot assembly or a snap-type collet hatch. To lock or unlock the "short" string within a J-slot locking mechanism typically required righthand rotation of the "short" string to come out of the J-slot mechanism into either the locked or unlocked position therein. In deviated holes, such mechanical rotation is oftentimes extremely difficult and does not provide an accurate indication of the locked-unlocked position with respect to a given number of tubular rotations recorded at the top of the well of the "short" string. In addition, such mechanical means typically do not permit selective and repeatable latching into the crossover assembly prior to the locking mode, in order to permit initial setting and location of the "short" string and thus permit retrieval of the tubing for purposes of accurately spacing out the "short" string at the wellhead. Failure to permit selective and repeatable latching prior to locking heretofore has meant that the "short" string would have to be stung into the crossover assembly prior to accurate spacing. This, in turn, has resulted in considerable tension being applied at and upon the latch due to expansion and contraction of the "short" tubing string as the result of injection or transmission of fluid therein. Accordingly, considerable set down weight has been required for application to the "short" string while it is locked into the crossover assembly to overcome the mechanical forces caused by thermotic variation.

The reliability of the lock of the "short" string into the crossover assembly in such an apparatus has been directly dependent upon the strength of the mechanical locking mechanism which, in turn, has been affected by temperature and pressure variances within the interior of the "short" string.

Of course, the deeper the well bore, the more tubing set down weight which has been required to be applied to the locking mechanism. Moreover, since tubular rotation may be required to latch and/or lock and unlock the "short" string within the crossover assembly, such rotational movement obviously is considerably more difficult to accomplish in dual completion wells utilizing a plurality of tubular strings.

The problems associated with the above-described prior art locking mechanisms are solved by utilization of the present invention which permits latching of a "short" string, or any given tubular string, into a conduit therefor by longitudinal manipulation of the "short" tubular string. Thereafter, the "short" string may be repeatably latched and unlatched until such time as it is desired to lock the "short" string into the conduit. The locking procedure does not require tubular manipulation, but is accomplished by hydraulic means. Unlocking of the apparatus also is accomplished by hydraulic means.

SUMMARY OF THE INVENTION

The present invention provides an apparatus for selective mechanically activated latching and fluid activated locking and unlocking of an end of tubular string within an anchor assembly in a subterranean well bore. The anchor assembly has defined thereon a first co-engaging means for selective latching and locking of the tubular string end with the anchor assembly. The present apparatus generally comprises a housing containing a second co-engaging means which are complimentaraly operational with the first co-engaging means. A longitudinally shiftable sleeve is initially secured interior of and to at least one of the housing in the second co-engaging means and is initially positioned with respect to the second co-engaging means whereby the second co-engaging means is selectively and repeatably latchable with respect to the first co-engaging means. First seat means are provided for sealing receipt of a first sealing element, whereby said sleeve means may be converted to a fluid responsive piston element to longitudinally shift one of the sleeve means and the second co-engaging means relative to the other of the sleeve means and the second co-engaging means to a first position whereby the first relative shifting to the first position will lock said second co-engaging means with the first co-engaging means. Second seat means also are provided for sealing receipt of a second sealing element whereby the sleeve means is converted to a piston to longitudinally shift either the sleeve means or the second co-engaging means relative to the other of the sleeve and the co-engaging means to a second position. In the second position, the first and second co-engaging means are in unlocked position.

BRIEF DESCRIPTION OF THE DRAWINGS

FIG. 3 is a view similar to that illustrated in FIG. 2, illustrating the position of the component parts of the present apparatus when the "short" string is latched into the crossover assembly.

FIG. 4 is a view similar to those illustrated in FIGS. 2 and 3, showing the "short" string in locked position within the crossover assembly.

FIG. 7 is a cross-sectional view taken along lines 7—7 of FIG. 3, illustrating the "short" string and the crossover assembly in latched relationship.

FIG. 8 is a cross-sectional view taken along lines 8—8 of FIG. 4, illustrating the "short" string locked within the crossover assembly.

DESCRIPTION OF THE PREFERRED EMBODIMENTS

In a preferred form, the present apparatus is illustrated in conjunction with a crossover assembly for use in association with dual tubing strings used in a dual completion.

The present apparatus generally comprises an anchor 100 for receipt within a longitudinally extending half portion thereof of a "short" string latch 200 which carries interiorally thereof a longitudinally extending sleeve 300. Also carried interiorally within the latch 200 is a shear ring 400.

Figure 1:
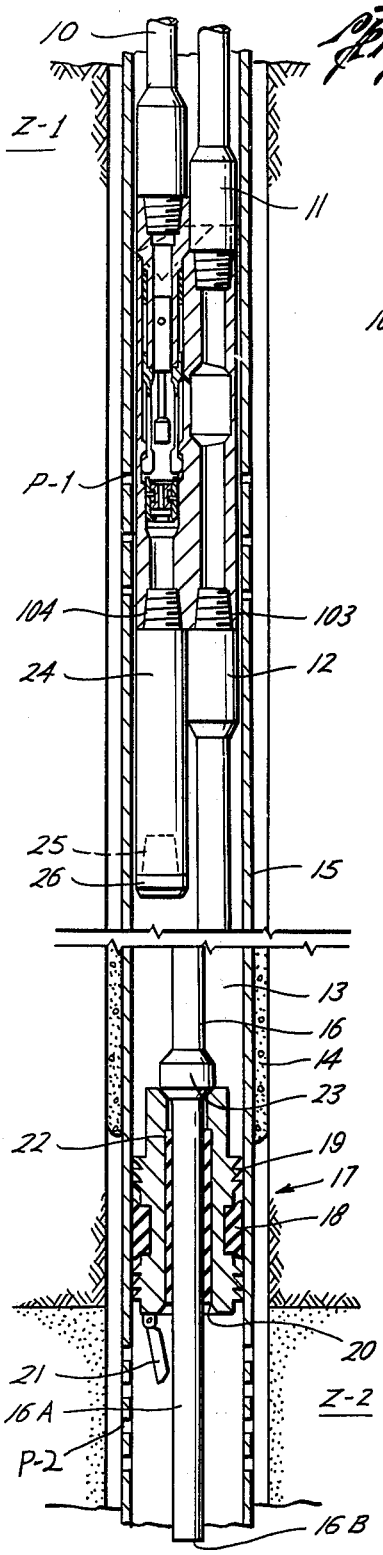
FIG. 1 is a somewhat diagramatic longitudinal section illustrating the present apparatus defined within a crossover assembly uitlized for the connection of dual production strings in a multi-zoned well, the "long" string carrying a packer mechanism therebelow for isolation and production of the lower zone through the "long" tubular string sealingly disposed therein.
Figure 6:
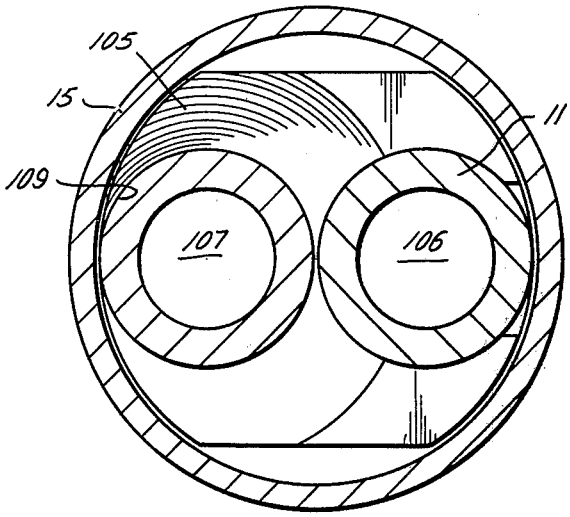
FIG. 6 is a view of the upper portion of the crossover assembly within which a plurality of individual tubular strings are communicable, and is taken along lines 6—6 of FIG. 2.

Referring now to FIG. 1, a packer mechanism 17 is shown as anchored and in sealing engagement on the inner wall of casing 15 above a lower zone Z2, the zone Z2 having perforations P2 therethrough to permit fluid transmission thereacross. The casing 15 is secured within the well bore 13 by means of cement 14. An upper zone Z1 is defined above the packer 17 with perforations P1 being defined across the casing 15 to permit fluid transmission thereacross.

Figure 2:
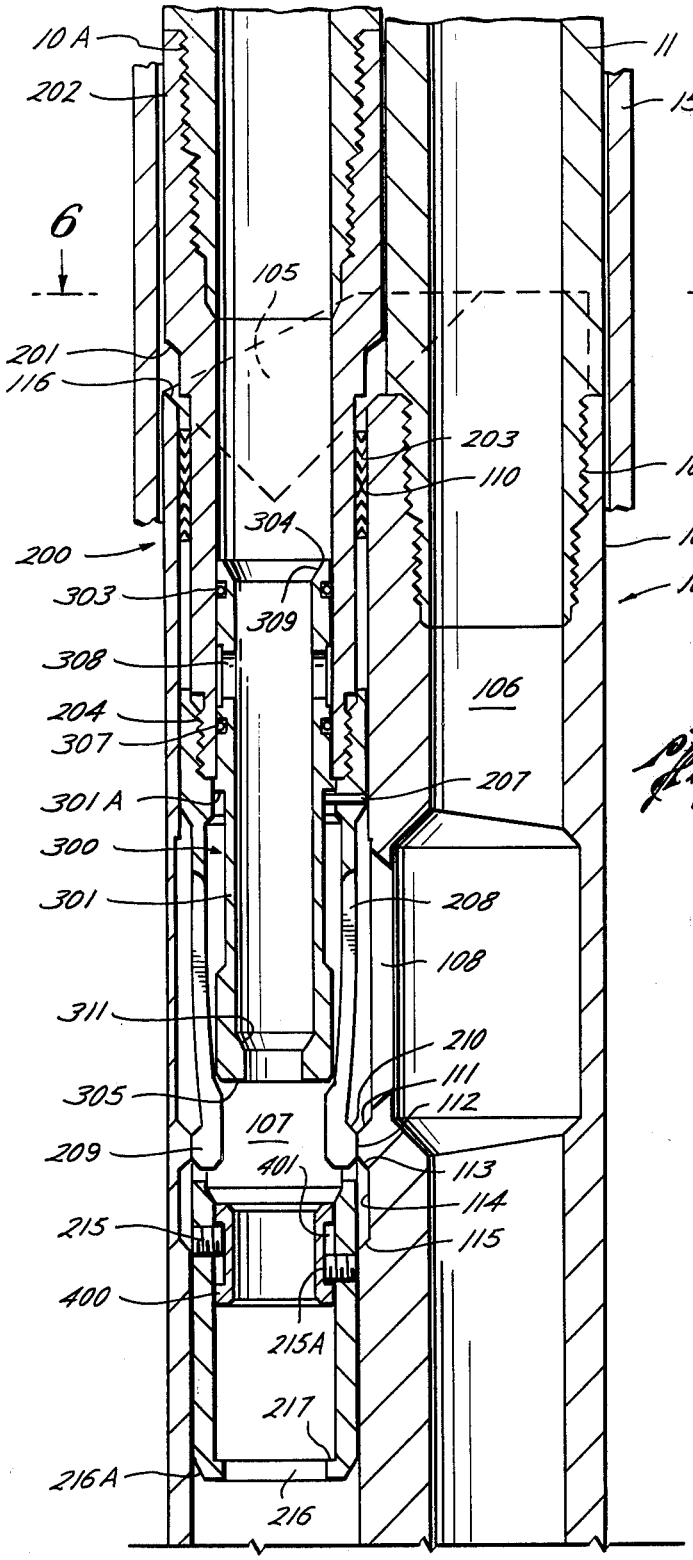
FIG. 2 is an enlarged view of a crossover assembly incorporating the present apparatus, a "short" string being landed within the crossover assembly and prior to being selectively latched therein.
Figure 5:
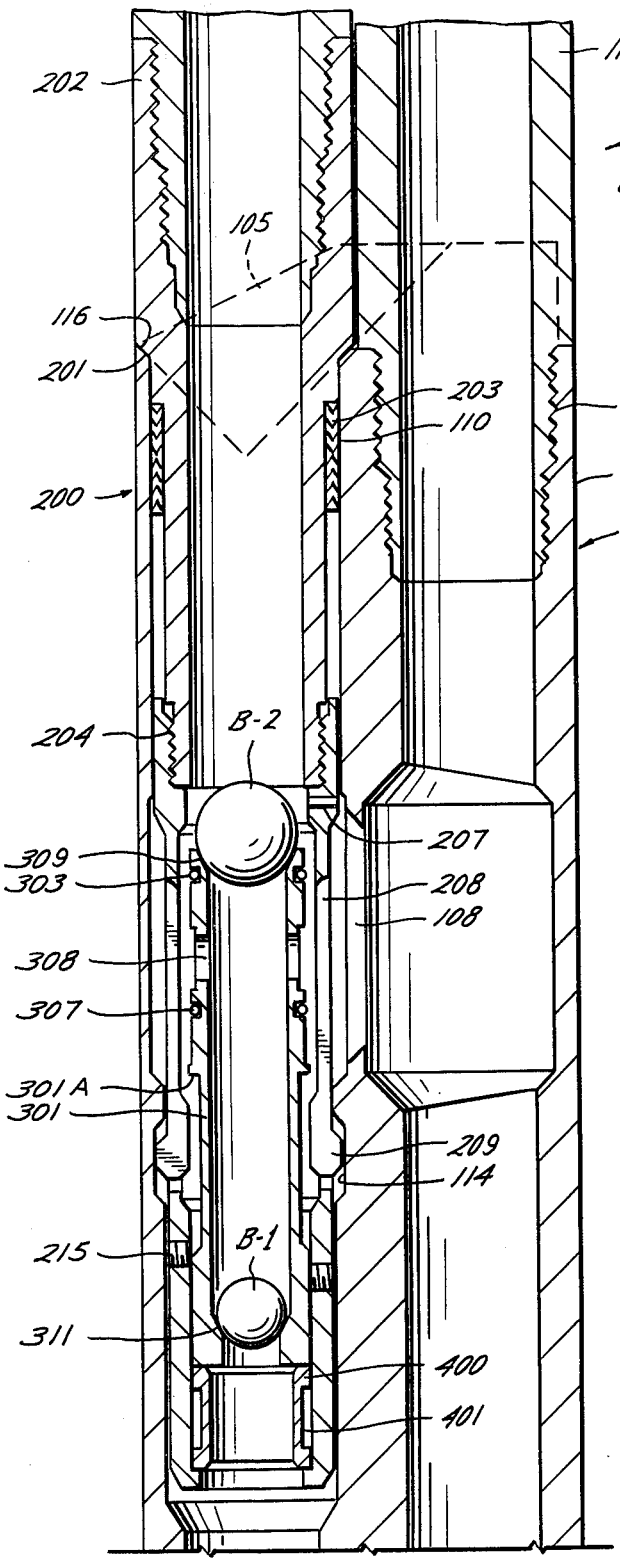
FIG. 5 is a view similar to those shown in FIGS. 2, 3 and 4, illustrating the present apparatus when the "short" string is in unlocked position within the crossover assembly, subsequent to the locked position shown in FIG. 4.

Now referring to FIGS. 1 and 2, the anchor 100 is exteriorally and longitudinally defined by an outer housing 101, cylindrical in configuration, and secured by threads 102 at its uppermost end to a long string 11 which, in turn, extends to the top of the well and is communicable therewith. Similar threads 103 secure the outer housing 101 to a longitudinally extending pup joint 12 below the anchor 100, the pup joint 12, in turn, being secured to a tubing joint 16 which is defined between the pup joint 12 and a tubing head 23.

A single bore packer assembly 17 having an elastomeric exteriorally protruding seal 18 and an anchor and slip mechanism 19 may be carried within the well on the tubing joint 16 or a setting string for location and setting on the casing 15 above the lower zone Z2. The packer 17 contains a valve head 21 which is held in open position by a tubing extension **16*a* having an open end 16*b*, the extension 16*a* being a continuation within the packer of the tubing joint 16 thereabove. A seal assembly 22 is carried on the extension 16*a* and within the bore 20 of the packer 17 to prevent fluid communication between the extension 16*a* and the packer 17**.

The packer 17 may be carried in the well below the tubing joint 16 or may be located, anchored and set within the well bore above the zone Z2 with a setting string (not shown). Thereafter the setting string is removed from the well and the "long" string 11 carrying the crossover assembly or anchor 100 with the seal assembly 22 is inserted into the well bore 13. The tubing extension **16*a*, tubing joint 16, pup joint 12, anchor 100 and the tubing string 11** all together define what is commonly referred to as the "long" string.

A tubing section 24 is secured to the outer housing 101 of the anchor 100 by means of threads 104, the tubing section 24 being sealingly isolated from the zone Z1 by utilization of a closed-ended bull plug 26 being secured thereto by means of threads 25.

A frusto-conical surface 105 formed in the top of the anchor 100 having a center concident with the centerline of the short string 10 is inclined at the uppermost end of the outer housing 101 of the anchor 100 for location and landing within a bore 109 of a "short" string latch 200.

Thus, as described, the anchor 100 provides means for cross communicable engagement with a plurality of production strings weithin a well. Accordingly, the interior of the outer housing 101 provides on one side thereof a longitudinally extending "long" string bore 106 for communication at its upper end with the "long" string 11 and for communication at its lower end with the pup joint 12. Concurrently, a similar "short" string bore 107 is defined longitudinally and within the opposite side of the anchor 100 for communication between the tubing 24 defined lowerly thereof and the "short" string section 10 selectively receivable therethrough. An intrapassage 108 also is provided within the housing 101 for selective communication between the bores 106 and 107.

The "short" string bore 107 has a smooth interior wall 110 at its upper end for sealing engagement of a series of chevron seals 203 carried exterior of the "short" string latch 200 when it is received through the bore 107 to prevent fluid communication between the latch 200 and the outer housing 101 of the anchor 100.

Immediately below the intrapassage 108 and adjacent to the bore 107 of the housing 101 is an inwardly beveled downwardly extending shoulder 111 for guiding inward contraction of a collet 208 of the latch 200. The shoulder 111 terminates in a longitudinally extending slide 112 having an abbreviated inner diameter and, in turn, terminating at a companion shoulder 113 which has an expanded diameter for providing a grooveway 114 for latachable and locking receipt of a spoon element 209 of the latch 200 within the anchor 100. The grooveway 114 terminates lowerly in an inwardly extending bevel 115.

A top stop 116 is defined at the upper end of the outer housing 101 and defines the upper end of the "short" string bore 107, and will no-go engage with a companionly defined shoulder 201 on the latch 200 when it is inserted within the anchor 100.

The short string latch 200, which is inserted within the bore 107 in the housing 101 of the anchor 100, is defined at its upper end by a locator seal sub 202 which is secured to the short string 10 by means of threads 10*a*. The inwardly beveled shoulder 201 is defined at the upper end of a seal sub 202 to define a no-go when it engages with a companion top stop 116 on the housing 101 of the anchor 100. A chevron seal assembly 203 is exteriorally carried longitudinally around the locator seal sub 202 to prevent fluid communication between the seal sub 202 and the housing 101 of the anchor 100.

Figure 9:
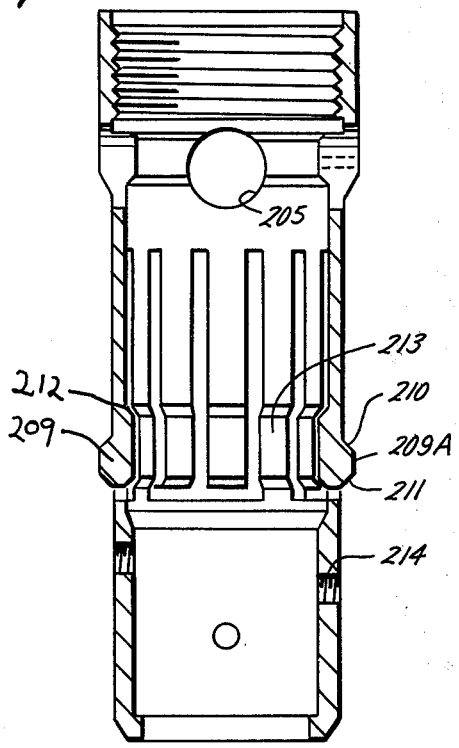
FIG. 9 is an enlarged view of a preferred collet assembly utilized in the invention.

The locator seal sub 202 is secured by means of threads 204 to a collet latch 208. The collet latch 208 has defined through its uppermost end a plurality of transverse ports 205 which provide additional fluid communication. A shear screw 207 protrudes inwardly of the latch 208 for securement within the latch 200 of the longitudinally extending interior sleeve 300. As particularly viewed in FIG. 9, an outwardly protruding spoon 209, is defined exterior on the latch 208 and has an upper shoulder 210 which terminates into a longitudinally extending abbreviated outer wall 209*a* which itself bevels into a lowerly facing shoulder 211. The spoon 209 of the collet latch 208 has defined within its interior a downwardly extending shoulder 212 which is inclined inwardly of the latch 208. An inner wall 213 circumferentially extends inwardly within the spoon 209 which communicates with the exterior of the sleeve 300 as the sleeve 300 is shifted longitudinally within the interior of the latch 200.

The collet latch 208 continues longitudinally and lowerly of the spoon 209 and defines a transverse bore 214 thereacross for receipt therein of a plurality of shear pins 215 having an inwardly protruding end 215*a* extending interiorally of the collet latch 208 and received within a grooveway 401 having an upper end 401*a* of the slidable shear ring 400. The collet latch 208 has an open end 216 and an upwardly facing shoulder 217 interiorally and circumferentially defined for receipt of the lower end of the longitudinally shiftable shear ring 400 when it is disengaged from the shear pin 215. A beveled shoulder 216*a* is circumferentially defined around the lowermost exterior end of the collet latch 208 to guide the collet latch 200 into position within the bore 107 of the anchor 100.

A longitudinally shiftable sleeve 300 is carried within the latch 200 and is held in initial placement therein by means of the shear screw 207. The sleeve 300 consists of an outer housing 301 having a shoulder 301*a* for receipt thereupon of the shear screw 207. A beveled seat 309 is defined at the open upper end 304 of the housing 301 having an outer wall 310 with a protracted wall portion 310*a*, and provides a seal seat for a ball B-2 insertable within the short string 10, when it is desired to unlock the latch 200 within the anchor 100. Upper and lower circumferentially extending elastomeric O-ring seal elements 303 and 307 are carried within their respective grooveways 302 and 306 within the housing 301 to prevent fluid communication between the housing 301 and the locator seal sub 202, as well as to isolate a port 308 defined across the housing 301, the longitudinal shifting of the housing 301 permitting the port 308 to fluidly communicate with the ports 205 in the collet latch 208 to provide a fluid passageway across the latch 200 and to the "long" string bore 106 within the outer housing 101 of the anchor 100.

A lower and beveled diametrically contracted ball seal seat 311 is defined at the lower end of the housing 301 of the sleeve 300 for receipt of a ball element B-1 which is permitted to travel within the short string 10 from the top of the well and through the interior of the locator seal sub 202 and through the housing 301, when it is desired to lock the "short" strong latch 200, the sleeve 300 being transformed into a piston when the ball B-1 is sealingly engaged upon the seat 311 for hydraulic longitudinal shifting of the sleeve 300. The housing 301 has a lower open end 305 normally permitting fluid transmission therethrough and in communication with the "short" string bore 107 therebelow.

A ring-like shear element 400 is secured interior of the short string latch 200 by means of the end 215*a* of the shear pin 215, which is secured within the grooveway 401 of the ring 400. The ring 400 has upper and lower open ends 403 and 402, respectively, to permit fluid transmission within the interior of the ring 400. The upper end 403 of the shear ring 400 receives the lower end 305 of the sleeve 300 during the locking operation, the ring 400 preventing further downward longitudinal shifting of the sleeve 300 until the shear strength of the pins 215 is overcome.

OPERATION

When it is desired to stab the "short" string 10 into the anchor 100, the short string 10 is lowered into the well with the short string latch 200 secured to its lower end. As the short string 10 is lowered into the well, it is located at the depth immediate the anchor 100 and the open end 216 of the short string latch 200 will engage the guide 105 and slide into the bore 109 of the outer housing 101 of the anchor 100. After the lower end 216 of the latch 200 passes below the top stop 116 and into the bore 107 of the outer housing 101 of the anchor 100, the shoulder 211 of the spoon 209 on the collet latch 208 will contact the top stop 116, continued downward longitudinal travel of the short string 10 causing the spoon portion 209 of the collet latch 208 to contract inwardly. Thereafter, the outer wall 209*a* on the spoon 209 will free travel downwardly along the smooth wall 110 in the outer housing 101 of the anchor 100 until the shoulder 211 contacts the companion shoulder 111 on the outer housing 101 of the anchor 100. Again, continued lower longitudinal travel of the short string 10 will cause the spoon 209 to be contracted and flexed inwardly such that the outer wall 209*a* will pass downwardly along the slide 112 of the outer housing 101. When the outer wall 209*a* passes lowerly of the slide 112 and below the shoulder 113, the spoon 209 is permitted to expand outwardly and into the grooveway 114. After the spoon 209 is thus latched within the grooveway 114, the shoulder 201 on the latch 200 will no-go upon the top stop 116 of the outer housing 101 to prevent further lower longitudinal travel of the latch 200 within the anchor 100. In this position, the short string 10 is latched, but is not locked, into the anchor 100. It should be noted that in this position, the short string 10 may be moved longitudinally upwardly, such that, when doing so, the upwardly facing shoulder 210 of the spoon 209 of the collet latch 208 will contact the downwardly facing companion shoulder 113 on the outer housing 101 of the anchor 100, whereby the spoon 209 of the collet latch 208 is again caused to contract inwardly and permit retrieval of the short string 10 away from the anchor 100.

In the latched position as described above, it should be noted that the housing 301 of the inner sleeve 300 is secured to the collet latch 208 by means of the shear screw 207. Additionally, the shear ring 400 is in stabilized position by means of the side 215*a* of the shear pins 215 being inserted within the longitudinal grooveway 401 of the ring 400.

When it is desired to lock the short string 10 into the anchor 100, the sleeve 300 is converted into a piston for hydraulic shifting thereof by inserting at the top of the well and through the short string 10 the smaller diameter ball B-1, which may gravitate through the interior of the short string 10 until it becomes sealingly engaged upon the seat 311 on the housing 301 of the sleeve 300. When the ball B-l is positioned on the seat 311, pressure within the short string 10 will be increased until the shear strength of the shear screw 207 is overcome, at which time the shear screw 207 will be sheared and the housing 301 will be permitted to travel longitudinally downwardly within the interior of the collet latch 208 until the open end 305 contacts the open end 403 of the shear ring 400. Continued downward travel of the housing 301 will cause the shear ring 400 to move downwardly, slightly, until the shear pin 215 is shouldered at the upper end 401*a* of the grooveway 401 on the ring 400, and further lower longitudinal travel of the housing 301 is thus prevented. Now, in this position, the port 308 communicates with the port 205 and the inner passage 108 and the long string bore 106, such that an indication of the positioning of the housing 301 lowerly within the collet latch 208 may be physically confirmed at the top of the well by return fluid circulation through the long string 11.

As the housing 301 is shifted downwardly, the wall portion 310*a* will slide along the inner wall 213 of the spoon 209 of the collet latch 208 and will be secured in this position when the shear ring 400 is shifted downwardly until the pins 215 engage the upper end 401*a* of the ring 400. In this position, the housing 301 of the sleeve 300 has passed below and inwardly within the spoon 209 to prevent inward contraction of the collet latch 208, so that the shoulders 210 will upwardly no-go with the shoulder 113 if the "short" string 10 is moved upwardly, thus locking the spoon 209 and the "short" string 10 within the grooveway 114.

The "short" string 10 may be selectively unlocked from within the anchor 100 at any given time, for example, after production of the upper zone Z-1, or transmission of treating fluid such as corrosion inhibitor from the short string 10 to the long string 11 by again converting the sleeve 300 into an hydraulically activatable longitudinally shiftable piston. The larger diameter ball B-2 is inserted within the short string 10 at the top of the well and is permitted to gravitate until such time as it becomes sealingly engaged upon the upper seat 309 of the housing 301. When the ball B-2 is so engaged, pressure within the short string 10 thereabove can be increased until the shear strength of the shear pins 215 is overcome, at which time the pins 215 will shear, freeing the ring 400 from engagement with the collet latch 208. Accordingly, the sleeve 300 and the shear ring 400 are permitted to travel longitudinally downwardly within the interior of the short string latch 200 until the shear ring 400 bottoms out on the shoulder 217 on the short string latch 200.

When the sleeve 300 is shifted downwardly as described above, the wall 310, which has a smaller outer diameter than the outer diameter of the wall portion 310*a* therebelow, will pass across the inner wall 213 of the spoon 209 of the collet latch 208, and the spoon 209 will be free to contract inwardly once again to freely slide across the shoulder 113 of the housing 101. The interface between the open end 402 of the shear ring 400 and the shoulder 217 of the collet latch 208 may be physically detected at the top of the well when fluid flow around the ball B-2 and across the ports 205 is transmitted within the interpassage 108 and the long string bore 106, thence to the top of the well through the "long" string 11. Thereafter, the "short" string 10 is picked up at the top of the well, the shoulder 210 of the spoon 209 engages the upwardly beveled shoulder 113 of the outer housing 101, and the spoon 109 is contracted inwardly and out of locked engagement within the grooveway 114.

Although the invention has been described in terms of specifield embodiments which are set forth in detail, it should be understood that this is by way of illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An apparatus for selective mechanically activated latching and hydraulically activated locking and unlocking of one end of a tubular string within an anchor assembly in a subterranean bore, said anchor assembly defining first co-engaging means thereon for selective latching and locking of said tubular string with said anchor assembly, said apparatus comprising: a housing: second co-engaging means for complimentary operation with said first co-engaging means; longitudinally shiftable sleeve means initially secured interior of and to at least one of said housing and said second co-engaging means, said sleeve means initially being positioned with respect to said second co-engaging means whereby said second co-engaging means may be selectively and repeatably latched with respect to said first co-engaging means; first seat means for sealing receipt of a first sealing element whereby said sleeve means is converted to an hydraulically responsive piston to longitudinally shift one of said sleeve means and said second co-engaging means relative to the other of said sleeve means and said second co-engaging means to a first position whereby said first relative shifting to said first position locks said second co-engaging means with said first co-engaging means; and second seat means for sealing receipt of a second sealing element whereby said sleeve means is converted to a piston to longitudinally shift one of said sleeve means and said second co-engaging means relative to the other of said sleeve means and said second co-engaging means to a second position whereby said second relative shifting to said second position unlocks said first and said second co-engaging means.

2. The apparatus of claim 1 wherein said second co-engaging means comprises a normally outwardly positioned, selectively contractable flexible collet member.

3. The apparatus of claim 1 wherein said longitudinally shiftable sleeve means is secured interior of and to said second co-engaging means by at least one element separatable upon application of predetermined hydraulically activated force thereacross.

4. The apparatus of claim 1 wherein said longitudinally shiftable sleeve means is secured interior of and to at least one of said housing and said second co-engaging means by at least one element separatable upon application of predetermined hydraulically activated force thereacross.

5. The apparatus of claim 1 wherein said first seat means defines a first valve seat for sealing receipt of a first sealing element for conversion of said sleeve means to a piston to longitudinally shift said sleeve means to said first position.

6. The apparatus of claim 1 wherein said second seat means defines a second valve seat for sealing receipt of a second sealing element for conversion of said sleeve means to a piston to longitudinally shift said sleeve means to said second position.

7. The apparatus of claim 1 additionally comprising means defining a first flow passage through said sleeve; means defining a second flow passage within at least one of said housing and said second co-engaging means; and means for selective isolation of said first flow passage with respect to said second flow passage, said first and second means defining a flow passage being in fluid communicable alignment upon shifting of said sleeve means to said first position.

8. The apparatus of claim 1 additionally comprising means defining a first flow passage through said sleeve; means defining a second flow passage within at least one of said housing and said second co-engaging means; and means for selective isolation of said first flow passage with respect to said second flow passage, said first and second means defining a flow passage being in fluid communicable alignment upon shifting of said sleeve means to each of said first and second positions.

9. The apparatus of claim 1 further comprising shearable no-go means for resisting longitudinal travel of said sleeve means in a first direction and defining said first position of said sleeve means.

10. The apparatus of claim 1 further comprising shearable no-go means for resisting longitudinal travel of said sleeve means in a first direction and defining said first position of said sleeve means, said shearable no-go means secured to at least one of said housing and said second co-engagable means.

11. An apparatus for selective mechanically latching and fluid activated locking and unlocking of one end of a tubular string within an anchor assembly in a subterranean bore, said anchor assembly defining first co-engaging means thereon for selective latching and locking of said tubular string with said anchor assembly, said apparatus comprising: a housing; second co-engaging means for complimentary operation with said first co-engaging means; longitudinally shiftable sleeve means initially secured interior of and to at least one of said housing and said second co-engaging means, said sleeve means initially being positioned with respect to said second co-engaging means whereby said second co-engaging means may be selectively and repeatably latched with respect to said first co-engaging means; first seat means for sealing receipt of a first sealing element whereby said sleeve means is converted to a fluid responsive piston to longitudinally shift one of said sleeve means and said second co-engaging means relative to the other of said sleeve means and said second co-engaging means to a first position, whereby said first relative shifting to said first position locks said second co-engaging means with said first co-engaging means; and second seat means for sealing receipt of a second sealing element whereby said sleeve means is converted to a piston to longitudinally shift one of said sleeve means and said second co-engaging means relative to the other of said sleeve means and said second co-engaging means to a second position whereby said second relative shifting to said second position unlocks said first and second co-engaging means.

12. The apparatus of claim 11 wherein said second co-engaging means comprises a normally outwardly positioned, selectively contractable flexible collet member.

13. The apparatus of claim 11 wherein said longitudinally shiftable sleeve means is secured interior of and to said second co-engaging means by at least one element separatable upon application of a predetermined fluid activated force thereacross.

14. The apparatus of claim 11 wherein said longitudinally shiftable sleeve means is secured interior of and to at least one of said housing and said second co-engaging means by at least one element separatable upon application of predetermined fluid activated force thereacross.

15. The apparatus of claim 11 wherein said first seat means defines a first valve seat for sealing receipt of a first sealing element for conversion of said sleeve means to a piston to longitudinally shift said sleeve means to said first position.

16. The apparatus of claim 11 wherein said second seat means defines a second valve seat for sealing receipt of a second sealing element for conversion of said sleeve means to a piston to longitudinally shift said sleeve means to said second position.

17. The apparatus of claim 11 additionally comprising means defining a first flow passage through said sleeve; means defining a second flow passage within at least one of said housing and said second co-engaging means; and means for selective isolation of said first flow passage with respect to said second passage, said first and second means defining a flow passage being in fluid communicable alignment upon shifting of said sleeve means to said first position.

18. The apparatus of claim 11 additionally comprising means defining a first flow passage through said sleeve; means defining a second flow passage within at least one of said housing and said second co-engaging means; and means for selective isolation of said first flow passage with respect to said second flow passage, said first and second means defining a flow passage being in fluid communicable alignment upon shifting of said sleeve means to each of said first and second positions.

19. The apparatus of claim 11 further comprising shearable no-go means for resisting longitudinal travel of said sleeve means in a first direction and defining said first position of said sleeve means.

20. The apparatus of claim 11 further comprising shearable no-go means for resisting longitudinal travel of said sleeve means in a first direction and defining said first position of said sleeve means, said shearable no-go means secured to at least one of said housing and said second co-engagable means.

21. An apparatus for selective mechanically latching and hydraulically activated locking and unlocking of one end of a first tubular member to one end of a second tubular member, comprising: a housing; first co-engaging means thereon; second co-engaging means complimentarally operational with said first co-engaging means for selective latching and locking of said first and second tubular members; longitudinally shiftable sleeve means initially secured interior of and to at least one of said housing and said second co-engaging means, said sleeve means initially being positioned with respect to said second co-engaging means whereby said second co-engaging means may be selectively and repeatably latched with respect to said first co-engaging means;

first seat means for sealing receipt of a first sealing element whereby said sleeve means is converted to an hydraulically responsive piston to longitudinally shift one of said sleeve means and said second co-engaging means relative to the other of said sleeve means and said second co-engaging means to a first position, whereby said first relative shifting to said first position locks said second co-engaging means with said first co-engaging means; and second seat means for sealing receipt of a second sealing element whereby said sleeve means is converted to a piston to longitudinally shift one of said sleeve means and said second co-engaging means relative to the other of said sleeve means and said second co-engaging means to a second position, whereby said second relative shifting to said second position unlocks said first and second co-engaging means.

22. The apparatus of claim 21 wherein one of said first and second co-engaging means defines a grooveway having an extended outer diameter for selective receipt of the other of said first and second co-engaging means.

23. The apparatus of claim 21 wherein one of said first and second co-engaging means defines a grooveway having an extended outer diameter for selective receipt of the other of said first and second co-engaging means, and said second co-engaging means comprises a normally expanded selectively contractable collet member.

24. The apparatus of claim 21 wherein said second co-engaging means comprises a normally outwardly positioned, selectively contractable flexible collet member.

25. The apparatus of claim 21 wherein said longitudinally shiftable sleeve means is secured interior of and to said second co-engaging means by at least one element separatable upon application of predetermined hydraulically activated force thereacross.

26. The apparatus of claim 21 wherein said longitudinally shiftable sleeve means is secured interior of and to at least one of said housing and said second co-engaging means by at least one element separatable upon application of predetermined hydraulically activated force thereacross.

27. The apparatus of claim 21 wherein said first seat means defines a first valve seat for sealing receipt of a first sealing element for conversion of said sleeve means to a piston to longitudinally shift said sleeve means to said first position.

28. The apparatus of claim 21 wherein said second seat means defines a second valve seat for sealing recipt of a second sealing element for conversion of said sleeve means to a piston to longitudinally shift said sleeve means to said second position.

29. The apparatus of claim 21 additionally comprising means defining a first flow passage through said sleeve; means defining a second flow passage within at least one of said housing and said second co-engaging means; and means for selective isolation of said first flow passage with respect to said second flow passage, said first and second means defining a flow passage being in fluid communicable alignment upon shifting of said sleeve means to said first position.

30. The apparatus of claim 21 additionally comprising means defining a first flow passage through said sleeve; means defining a second flow passage within at least one of said housing and said second co-engaging means; and means for selective isolation of said first flow passage with respect to said second flow passage, said first and second means defining a flow passage being in fluid communicable alignment upon shifting of said sleeve means to each of said first and second positions.

31. The apparatus of claim 21 further comprising shearable no-go means for resisting longitudinal travel of said sleeve means in a first direction and defining said first position of said sleeve means.

32. The apparatus of claim 21 further comprising shearable no-go means for resisting longitudinal travel of said sleeve means in a first direction and defining said first position of said sleeve means, said shearable no-go means being secured to at least one of said housing and said second co-engagable means.

33. An apparatus for selective mechanically activated latching and fluid activated locking and unlocking of one end of a first tubular member to one end of a second tubular member, comprising: a housing; first co-engaging means thereon; second co-engaging means complementarally operational with said first co-engaging means for selective latching and locking of said first and second tubular members; longitudinally shiftable sleeve means initially secured interior of and to at least one of said housing and said second co-engaging means, said sleeve means initially being positioned with respect to said second co-engaging means whereby said second co-engaging means may be selectively and repeatably latched with respect to said first co-engaging means; first seat means for sealing receipt of a first sealing element whereby said sleeve means is converted to a fluid responsive piston to longitudinally shift one of said sleeve means and said second co-engaging means relative to the other of said sleeve means and said second co-engaging means to a first position, whereby said first relative shifting to said first position locks said second co-engaging means with said first co-engaging means; and second seat means for sealing receipt of a second sealing element whereby said sleeve means is converted to a piston to longitudinally shift one of said sleeve means and said second co-engaging means relative to the other of said sleeve means and said second co-engaging means to a second position whereby said second relative shifting to said second position unlocks said first and second co-engaging means.

34. The apparatus of claim 33 wherein said second co-engaging means comprises a normally outwardly positioned, selectively contractable flexible collet member.

35. The apparatus of claim 33 wherein said longitudinally shiftable sleeve means is secured interior of and to said second co-engaging means by at least one element separatable upon application of predetermined fluid activated force thereacross.

36. The apparatus of claim 33 wherein said longitudinally shiftable sleeve means is secured interior of and to at least one of said housing and said second co-engaging means by at least one element separatable upon application of predetermined fluid activated force thereacross.

37. The apparatus of claim 33 wherein said first seat means defines a second valve seat for sealing receipt of a first sealing element for conversion of said sleeve means to a piston to longitudinally shift said sleeve means to said first position.

38. The apparatus of claim 33 wherein said second seat means defines a second valve seat for sealing receipt of a second sealing element for conversion of said sleeve means to a piston to longitudinally shift said sleeve means to said second position.

39. The apparatus of claim 33 additionally comprising means defining a first flow passage through said sleeve;

means defining a second flow passage within at least one of said housing and said second co-engaging means; and means for selective isolation of said first flow passage with respect to said second flow passage, said first and second means defining a flow passage being in fluid communicable alignment upon shifting of said sleeve means to said first position.

40. The apparatus of claim 33 additionally comprising means defining a first flow passage through said sleeve; means defining a second flow passage within at least one of said housing and said second disengaging means; and means for selective isolation of said first flow passage with respect to said second flow passage, said first and second means defining a flow passage being in fluid communicable alignment upon shifting of said sleeve means to each of said first and second positions.

41. The apparatus of claim 33 further comprising shearable no-go means for resisting longitudinal travel of said sleeve means in a first direction and defining said first position of said sleeve means.

42. The apparatus of claim 33 further comprising shearable no-go means for resisting longitudinal travel of said sleeve means in a first direction and defining said first position of said sleeve means, said shearable no-go means secured to at least one of said housing and said second co-engageable means.

43. The apparatus of claim 21 additionally comprising a guide surface inclined downwardly to guide one of said first and second tubular members into said housing.

44. The apparatus of claim 33 additionally comprising a guide surface inclined downwardly to guide one of said first and second tubular members into said housing.

45. An apparatus for selective mechanically latching and hydraulically activated locking and unlocking of one end of a first tubular member to one end of a second tubular member said first tubular member having first co-engaging means thereon, comprising: a housing; second co-engaging means complimentarally operational with said first co-engaging means for selective latching and locking of said first and second tubular members; longitudinally shiftable sleeve means initially secured interior of and to at least one of said housing and said second co-engaging means, said sleeve means initially being positioned with respect to said second co-engaging means whereby said second co-engaging means may be selectively and repeatably latched with respect to said first co-engaging means; first seat means for sealing receipt of a first sealing element whereby said sleeve means is converted to an hydraulically responsive piston to longitudinally shift one of said sleeve means and said second co-engaging means relative to the other of said sleeve means and said second co-engaging means to a first position, whereby said first relative shifting to said first position locks said second co-engaging means with said first co-engaging means; and second seat means for sealing receipt of a second sealing element whereby said sleeve means is converted to a piston to longitudinally shift one of said sleeve means and said second co-engaging means relative to the other of said sleeve means and said second co-engaging means to a second position, whereby said second relative shifting to said second position unlocks said first and second co-engaging means.

46. The apparatus of claim 45 wherein one of said first and second co-engaging means defines a grooveway having an extended outer diameter for selective receipt of the other of said first and second co-engaging means.

47. The apparatus of claim 45 wherein one of said first and second co-engaging means defines a grooveway having an extended outer diameter for selective receipt of the other of said first and second co-engaging means, and said second co-engaging means comprises a normally expanded selectively contractable collet member.

48. The apparatus of claim 45 wherein said second co-engaging means comprises a normally outwardly positioned, selectively contractable flexible collet member.

49. The apparatus of claim 45 wherein said longitudinally shiftable sleeve means is secured interior of and to said second co-engaging means by at least one element separatable upon application of predetermined hydraulically activated force thereacross.

50. The apparatus of claim 45 wherein said longitudinally shiftable sleeve means is secured interior of and to at least one of said housing and said second co-engaging means by at least one element separatable upon application of predetermined hydraulically activated force thereacross.

51. The apparatus of claim 45 wherein said first seat means defines a first valve seat for sealing receipt of a first sealing element for conversion of said sleeve means to a piston to longitudinally shift said sleeve means to said first position.

52. The apparatus of claim 45 wherein said second seat means defines a second valve seat for sealing recipt of a second sealing element for conversion of said sleeve means to a piston to longitudinally shift said sleeve means to said second position.

53. The apparatus of claim 45 additionally comprising means defining a first flow passage through said sleeve; means defining a second flow passage within at least one of said housing and said second co-engaging means; and means for selective isolation of said first flow passage with respect to said second flow passage, said first and second means defining a flow passage being in fluid communicable alignment upon shifting of said sleeve means to said first position.

54. The apparatus of claim 45 additionally comprising means defining a first flow passage through said sleeve; means defining a second flow passage within at least one of said housing and said second co-engaging means; and means for selective isolation of said first flow passage with respect to said second flow passage, said first and second means defining a flow passage being in fluid communicable alignment upon shifting of said sleeve means to each of said first and second positions.

55. The apparatus of claim 45 further comprising shearable no-go means for resisting longitudinal travel of said sleeve means in a first direction and defining said first position of said sleeve means.

56. The apparatus of claim 45 further comprising shearable no-go means for resisting longitudinal travel of said sleeve means in a first direction and defining said first position of said sleeve means, said shearable no-go means being secured to at least one of said housing and said second co-engageable means.

57. An apparatus for selective mechanically activated latching and fluid activated locking and unlocking of one end of a first tubular member to one end of a second tubular member, said first tubular member having first co-engaging means thereon, comprising: a housing; second co-engaging means complimentarally operational with said first co-engaging means for selective latching and locking of said first and second tubular members; longitudinally shiftable sleeve means initially secured interior of and to at least one of said housing and said second co-engaging means, said sleeve means initially being positioned with respect to said second co-engaging means whereby said second co-engaging means may be selectively and repeatably latched with respect to said first co-engaging means; first seat means for sealing receipt of a first sealing element whereby said sleeve means is converted to a fluid responsive piston to longitudinally shift one of said sleeve means and said second co-engaging means relative to the other of said sleeve means and said second co-engaging means to a first position, whereby said first relative shifting to said first position locks said second co-engaging means with said first co-engaging means; and second seat means for sealing receipt of a second sealing element whereby said sleeve means is converted to a piston to longitudinally shift one of said sleeve means and said second co-engaging means relative to the other of said sleeve means and said second co-engaging means to a second position whereby said second relative shifting to said second position unlocks said first and second co-engaging means.

58. The apparatus of claim 57 wherein said second co-engaging means comprises a normally outwardly positioned, selectively contractable flexible collet member.

59. The apparatus of claim 57 wherein said longitudinally shiftable sleeve means is secured interior of and to said second co-engaging means by at least one element separatable upon application of predetermined fluid activated force thereacross.

60. The apparatus of claim 57 wherein said longitudinally shiftable sleeve means is secured interior of and to at least one of said housing and said second co-engaging means by at least one element separatable upon application of predetermined fluid activated force thereacross.

61. The apparatus of claim 57 wherein said first seat means defines a second valve seat for sealing receipt of a first sealing element for conversion of said sleeve means to a piston to longitudinally shift said sleeve means to said first position.

62. The apparatus of claim 57 wherein said second seat means defines a second valve seat for sealing receipt of a second sealing element for conversion of said sleeve means to a piston to longitudinally shift said sleeve means to said second position.

63. The apparatus of claim 57 additionally comprising means defining a first flow passage through said sleeve; means defining a second flow passage within at least one of said housing and said second co-engaging means; and means for selective isolation of said first flow passage with respect to said second flow passage, said first and second means defining a flow passage being in fluid communication alignment upon shifting of said sleeve means to said first position.

64. The apparatus of claim 57 additionally comprising means defining a first flow passage through said sleeve; means defining a second flow passage within at least one of said housing and said second co-engaging means; and means for selective isolation of said first flow passage with respect to said second flow passage, said first and second means defining a flow passage being in fluid communicable alignment upon shifting of said sleeve means to each of said first and second positions.

65. The apparatus of claim 57 further comprising shearable no-go means for resisting longitudinal travel of said sleeve means in a first direction and defining said first position of said sleeve means.

66. The apparatus of claim 57 further comprising shearable no-go means for resisting longitudinal travel of said sleeve means in a first direction and defining said first position of said sleeve means, said shearable no-go means secured to at least one of said housing and said second co-engageable means.

67. The apparatus of claim 57 additionally comprising a guide surface inclined downwardly to guide one of said first and second tubular members into said housing.

68. The apparatus of claim 57 additionally comprising a guide surface inclined downwardly to guide one of said first and second tubular members into said housing.

* * * * *